United States Patent [19]

Klimpel et al.

[11] Patent Number: 4,702,822

[45] Date of Patent: Oct. 27, 1987

[54] NOVEL COLLECTOR COMPOSITION FOR FROTH FLOTATION

[75] Inventors: Richard R. Klimpel; Robert D. Hansen, both of Midland, Mich.

[73] Assignee: The Dow Chemical Company, Midland, Mich.

[21] Appl. No.: 875,836

[22] Filed: Jun. 18, 1986

Related U.S. Application Data

[63] Continuation-in-part of Ser. No. 754,328, Jul. 12, 1985, abandoned.

[51] Int. Cl.[4] ..... B03D 1/02

[52] U.S. Cl. ..... 209/166; 252/61; 209/167

[58] Field of Search ..... 252/61; 209/166, 167

[56] References Cited

U.S. PATENT DOCUMENTS

| | | | |
|---|---|---|---|
| 1,801,318 | 4/1931 | Moses et al. | 209/166 |
| 1,801,319 | 4/1931 | Moses et al. | 209/166 |
| 1,819,112 | 8/1931 | Perkins | 252/61 |
| 1,833,740 | 11/1931 | Derby et al. | 252/61 |
| 2,027,357 | 1/1936 | Moses et al. | 209/166 |
| 2,127,375 | 8/1938 | Bousquet | 209/166 |
| 2,169,313 | 8/1939 | Williams et al. | 252/61 |
| 2,469,368 | 5/1949 | Carvagal et al. | 209/166 |
| 2,644,580 | 7/1953 | Robbins et al. | 209/166 |
| 2,691,635 | 6/1954 | Harris et al. | 209/166 |
| 2,695,316 | 11/1954 | McBride | 209/166 |
| 3,006,471 | 10/1961 | Luttinger | 209/166 |
| 3,059,774 | 10/1962 | Wilson | 209/166 |
| 3,469,692 | 9/1969 | Freyberger | 209/166 |
| 3,590,996 | 7/1971 | Harris | 209/166 |
| 3,590,997 | 7/1971 | Harris et al. | 209/166 |
| 3,590,998 | 7/1971 | Collins et al. | 209/166 |
| 3,590,999 | 7/1971 | Gould et al. | 209/166 |
| 3,710,939 | 1/1973 | Hostynek et al. | 209/166 |
| 3,772,345 | 11/1973 | Ham et al. | 260/455 A |
| 3,787,471 | 1/1974 | Harris et al. | 260/455 A |
| 3,853,751 | 12/1974 | Harris et al. | 209/166 |
| 3,907,854 | 9/1975 | Bolth et al. | 260/455 A |
| 3,925,218 | 12/1975 | Zipperian et al. | 252/61 |
| 3,963,768 | 6/1976 | Millauer et al. | 260/455 A |
| 3,975,264 | 8/1976 | Bolth et al. | 209/166 |
| 4,022,686 | 5/1977 | Arakatsu et al. | 209/166 |
| 4,040,950 | 8/1977 | Zipperian et al. | 209/166 |
| 4,211,644 | 7/1980 | Wiechers | 209/166 |
| 4,295,962 | 10/1981 | Parlman et al. | 209/167 |
| 4,298,524 | 11/1981 | Calcagno | 260/239 BF |
| 4,341,715 | 7/1982 | Parlman et al. | 260/455 B |

FOREIGN PATENT DOCUMENTS

| | | | |
|---|---|---|---|
| 1105156 | 7/1981 | Canada | 252/61 |
| 373994 | 6/1977 | U.S.S.R. . | |
| 833326 | 5/1981 | U.S.S.R. . | |

OTHER PUBLICATIONS

King, "Principles of Flotation," South African Institute of Mining and Metallurgy, Johannesburg, South Africa (1982).

Crozier, "Changing Patterns in the Supply of Flotation Reagents", *Mining ISI* (3) (Sep. 1984).

*Primary Examiner*—Robert A. Wax

[57] ABSTRACT

This invention relates to a novel composition which is useful as a collector for the recovery of nonferrous metal-containing sulfide minerals and sulfidized metal-containing oxide minerals from ores in a froth flotation process. The novel composition comprises (a) an organic compound containing one or more monosulfide units wherein the sulfur atom(s) are bound to aliphatic or cycloaliphatic carbon atoms, and the total carbon content of the compound is such that the compound has sufficient hydrophobic character to cause metal-containing sulfide mineral or sulfidized metal-containing oxide mineral particles to be driven to an air/bubble interface; and (b) an alkyl thiocarbonate, a thionacarbamate, a thiophosphate, or mixtures thereof.

32 Claims, No Drawings

NOVEL COLLECTOR COMPOSITION FOR FROTH FLOTATION

CROSS-REFERENCE TO RELATED APPLICATION

This application is a continuation-in-part of copending application Ser. No. 754,328 filed July 12, 1985, now abandoned.

BACKGROUND OF THE INVENTION

This invention relates to a novel collector composition useful for the recovery of metal-containing sulfide minerals and sulfidized metal-containing oxide minerals from ores by froth flotation.

Flotation is a process of treating a mixture of finely divided mineral solids, e.g., a pulverulent ore, suspended in a liquid whereby a portion of such solids is separated from other finely divided mineral solids, e.g., clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth. The phenomena which makes flotation a particularly valuable industrial operation appear to be largely associated with selective affinity of the surface of particulated solids, suspended in a liquid containing entrapped gas, for the liquid on the one hand, the gas on the other.

Various flotation agents have been admixed with the suspension to improve the frothing process. Such added agents are classed according to the function to be performed and include collectors such as xanthates, thionocarbamates and the like; frothers which impart the property of forming a stable froth, e.g., natural oils such as pine oil and eucalyptus oil; modifiers such as activators to induce flotation in the presence of a collector, e.g., copper sulfate; depressants, e.g., sodium cyanide, which tend to prevent a collector from functioning as such on a mineral which it is desired to retain in the liquid, and thereby discourage a substance from being carried up and forming a part of the froth; pH regulators to produce optimum metallurgical results, e.g., lime, soda ash and the like. The specific additives are selected for use according to the nature of the ore, the mineral sought to be recovered and the other additaments which are to be used in combination therewith.

The flotation principle is applied in a number of mineral separation processes among which is the selective separation of such metal sulfide minerals as those containing copper, zinc, lead, nickel, molybdenum and other metal sulfide minerals containing primarily iron such as pyrite and pyrrhotite.

Once recovered, the metal-containing minerals are converted to the more useful pure metal state, often by a smelting process. Such smelting processes can result in the formation of volatile sulfur compounds. These volatile sulfur compounds are often released to the atmosphere through smokestacks, or are removed from such smokestacks by expensive and elaborate scrubbing equipment.

Among collectors commonly used for the recovery of metal-containing sulfide minerals or sulfidized metal-containing oxide minerals are xanthates, dithiophosphates, and thionocarbamates. Unfortunately, these materials are not particularly selective in the recovery of sulfide or sulfidized oxide minerals. For example, many nonferrous metal containing sulfide minerals or metal-containing oxide minerals are found naturally in ores which also consist of sulfide minerals containing primarily iron. When these iron-containing sulfide minerals are recovered in flotation processes along with the non-ferrous metal-containing sulfide minerals and sulfidized metal-containing oxide minerals, there is excess sulfur present which is released in the smelting processes resulting in an undesirably high amount of sulfur present during the smelting operations. The xanthates, thionocarbamates, and dithiophosphates do not selectively recover nonferrous metal-containing sulfide minerals in the presence of iron-containing sulfide minerals. On the contrary, such collectors collect and recover all metal-containing sulfide minerals.

Therefore, it would be highly desirable to provide a composition which is capable of selectively recovering, at good recovery rates and selectivities, a broad range of metal-containing minerals from mineral ores, including the metal-containing sulfide minerals or sulfidized metal-containing oxide minerals in the presence of sulfide minerals containing primarily iron.

SUMMARY OF THE INVENTION

This invention, in one aspect, is a novel composition comprising (a) an organic compound containing at least 4 carbon atoms and one or more monosulfide units, and (b) an alkyl thiocarbonate, a thionocarbamate, a thiophosphate, or mixtures thereof.

In another aspect, the invention also resides in a method for recovering metal-containing minerals from an ore which comprises subjecting the ore, in the form of an aqueous pulp, to a froth flotation process in the presence of a flotation collector at conditions such that the metal-containing mineral(s) are recovered in the froth, wherein the collector comprises the above-described composition.

The compositions of this invention provide surprisingly high recovery of nonferrous metal-containing sulfide minerals or sulfidized metal-containing oxide minerals, and a surprisingly high selectivity toward such nonferrous metal-containing sulfides and sulfidized metal-containing oxide minerals when such sulfide or sulfidized oxide minerals are found in the presence of ferrous-containing sulfide minerals. These compositions also demonstrate good recovery and good kinetics.

DETAILED DESCRIPTION OF THE INVENTION

One component of the novel collector composition of this invention is an organic compound which contains at least 4 carbon atoms and one or more monosulfide units. Most preferably, the sulfur atom(s) of the monosulfide unit(s) are bound to non-aromatic carbon atoms, i.e., aliphatic or cycloaliphatic carbon atoms (hereinafter referred to as "sulfide collector").

Preferred sulfide collectors correspond to the formula $$R^1—S—R_2 \quad (I)$$

wherein $R^1$ and $R^2$ are independently a hydrocarbyl radical or a substituted hydrocarbyl radical $R^1$ and $R^2$ together contain at least 4 carbon atoms and $R^1$ and $R^2$ may combine to form a heterocyclic ring structure with S; with the proviso that each carbon to which a sulfur atom is bound is a non-aromatic carbon atom.

If substituted, the hydrocarbyl is preferably substituted with one or more hydroxy, cyano, halo, ether, epoxy (i.e.,

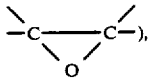

—$OR^3$ or —$SR^3$ moiety wherein $R^3$ is a hydrocarbyl radical.

In general, each $R^1$ and $R^2$ are advantageously independently an aliphatic, cycloaliphatic or aralkyl moiety, unsubstituted or substituted with one or more hydroxy, cyano, halo, —$OR^3$, or —$SR^3$ moieties, and $R^1$ and $R^2$ may combine to form a heterocyclic ring with S. $R^1$ and $R^2$ are more advantageously an aliphatic or cycloaliphatic moiety, unsubstituted or substituted with a hydroxy, cyano, halo, —$OR^3$, or —$SR^3$ moiety. In a preferred embodiment, $R^1$ and $R^2$ are alkyl, alkenyl or cycloalkyl; unsubstituted or substituted with one or more hydroxy, halo, cyano, —$OR^3$ or —$SR^3$ moieties, wherein $R^3$ is aliphatic or cycloaliphatic, preferably alkyl, alkenyl or cycloalkyl. In a more preferred embodiment, $R^1$ and $R^2$ are not the same hydrocarbon moiety, that is, the monosulfide is asymmetrical. In a most preferred embodiment, $R^1$ is methyl or ethyl and $R^2$ is a $C_{5-11}$ alkyl group.

Included within the definition of formula (I) are sulfide collectors having the structural formula:

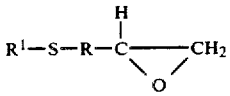

(Ia)

and $$R^1—S—R^2—S—R^1 \quad \text{(Ib)}$$

wherein R is a hydrocarbyl or substituted hydrocarbyl group, and $R^1$ and $R^2$ are as hereinbefore defined, each $R^1$ in formula (Ib) is the same or different. Preferably, R is a $C_{1-10}$ aliphatic or cycloaliphatic group, more preferably a $C_{1-10}$ alkyl or alkenyl group.

Examples of cyclic compounds which are sulfide collectors include compounds of the following formulas:

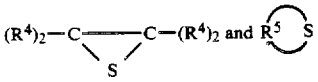

(IIa) (IIb)

wherein each $R^4$ is independently hydrogen, a hydrocarbyl or substituted hydrocarbyl group, provided at least one $R^4$ is not hydrogen; and $R^5$ is a straight- or branched hydrocarbyl or unsubstituted hydrocarbyl group. Preferably, $R^4$ is hydrogen or a $C_{1-12}$ aliphatic or cycloaliphatic group, unsubstituted or substituted with a hydroxy, cyano, halo, —$OR^3$ or —$SR^3$ moiety; more preferably hydrogen or a $C_{1-18}$ alkyl or alkenyl group, most preferably, hydrogen or a $C_{1-8}$ alkyl group, with at least two $R^4$'s being hydrogen.

The total carbon content of the hydrocarbon portion of the monosulfide collector is selected such that the sulfide collector is effective in floating metal-containing sulfide minerals or sulfidized metal-containing mineral particles. The total carbon content of the sulfide collector is such that the minimum number of carbon atoms is 4, preferably 6, and more preferably 8. The maximum number of carbon atoms is preferably 20, more preferably 16, and most preferably 12.

Of the foregoing, preferred monosulfide collectors are

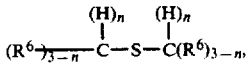

(IIIa)

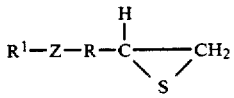

(IIIb)

and

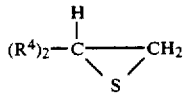

(IIIc)

wherein R, $R^1$ and $R^4$ are as hereinbefore defined; each $R^6$ is independently an aliphatic or substituted aliphatic group; Z is oxygen or sulfur; and n is an integer of 0, 1, 2 or 3; with the proviso that the total number of carbon atoms in the compounds is at least 4.

Preferably, each $R^6$ is an aliphatic unsubstituted or substituted with a cyano, hydroxy, halo, —$OR^3$ or —$SR^3$ moiety, wherein $R^3$ is as hereinbefore defined. Preferably, n is 1, 2 or 3, and more preferably 2 or 3. More preferably, $R^6$ is an alkyl, alkenyl, cycloalkyl or cycloalkenyl moiety. Most preferably, one —$C(H)_n(R^6)_{3-n}$ is a methyl or ethyl moiety, and the other is a $C_{5-11}$ alkyl or alkenyl moiety.

Examples of hydrocarbon sulfides within the scope of this invention include methylbutyl sulfide, methylpentyl sulfide, methylhexyl sulfide, methylheptyl sulfide, methyloctyl sulfide, methylnonyl sulfide, methyldecyl sulfide, methylundecyl sulfide, methyldodecyl sulfide, methylcyclopentyl sulfide, methylcyclohexyl sulfide, methylcycloheptyl sulfide, methylcyclooctyl sulfide, ethylbutyl sulfide, ethylpentyl sulfide, ethylhexyl sulfide, ethylheptyl sulfide, ethyloctyl sulfide, ethylnonyl sulfide, ethyldecyl sulfide, ethylundecyl sulfide, ethyldodecyl sulfide, ethylcyclopentyl sulfide, ethylcyclohexyl sulfide, ethylcycloheptyl sulfide, ethylcyclooctyl sulfide, propylbutyl sulfide, propylpentyl sulfide, propylhexyl sulfide, propylheptyl sulfide, propyloctyl sulfide, propylnonyl sulfide, propyldecyl sulfide, propylundecyl sulfide, propyldodecyl sulfide, propylcyclopentyl sulfide, propylcyclohexyl sulfide, propylcycloheptyl sulfide, propylcyclooctyl sulfide, dibutyl sulfide, butylpentyl sulfide, butylhexyl sulfide, butylheptyl sulfide, butyloctyl sulfide, butylnonyl sulfide, butyldecyl sulfide, butylundecyl sulfide, butyldodecyl sulfide, butylcyclopentyl sulfide, butylcyclohexyl sulfide, butylcycloheptyl sulfide, butylcyclooctyl sulfide, dipentyl sulfide, pentylhexyl sulfide, pentylheptyl sulfide, pentyloctyl sulfide, pentylnonyl sulfide, pentyldecyl sulfide, pentylundecyl sulfide, pentyldodecyl sulfide, pentylcyclopentyl sulfide, pentylcyclohexyl sulfide, pentylcycloheptyl sulfide, pentylcyclooctyl sulfide, dihexyl sulfide, hexylheptyl sulfide, hexyloctyl sulfide, hexylnonyl sulfide, hexyldecyl sulfide, hexylundecyl sulfide, hexyldodecyl sulfide, hexylcyclopentyl sulfide, hexylcyclohexyl sulfide, hexylcycloheptyl sulfide, hexylcyclooctyl sulfide, diheptyl sulfide, heptyloctyl sulfide, heptylnonyl sulfide, heptyldecyl sulfide, heptylundecyl sulfide, heptyldodecyl sulfide, heptylcyclopentyl sulfide, heptylcyclohexyl sulfide, heptylcycloheptyl sulfide, heptylcyclooctyl sulfide, dioctyl sulfide, octylnonyl sulfide, octyldecyl sulfide, octylundecyl sulfide, octyldodecyl sulfide, octylcyclopentyl sulfide, octylcyclohexyl sulfide, octylcycloheptyl sulfide, octylcyclooctyl sulfide, dinonyl sulfide, nonyldecyl sulfide, nonylundecyl sulfide, nonyldodecyl sulfide, nonylcyclopentyl sulfide, nonylcyclohexyl sulfide, nonylcycloheptyl sulfide, nonylcyclooctyl sulfide, didecyl sulfide, decylundecyl sulfide, decyldodecyl sulfide, decylcyclopentyl sulfide, decylcyclohexyl sulfide, decylcycloheptyl sulfide, and decylcyclooctyl sulfide. More preferred sulfides include methylpentyl sulfide, methylhexyl sulfide, methylheptyl sulfide, methyloctyl sulfide, methylnonyl sulfide, methyldecyl sulfide, ethylpentyl sulfide, ethylhexyl sulfide, ethylheptyl sulfide, ethyloctyl sulfide, ethylnonyl sulfide and ethyldecyl sulfide.

The second component of the novel collector composition of this invention is an alkyl thiocarbonate, a thionocarbamate, a thiophosphate, or mixtures thereof. Preferred alkyl thiocarbonates correspond to the formula

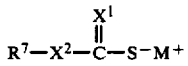

(IV)

wherein $R^7$ is a $C_{1-20}$, preferably $C_{2-16}$, more preferably $C_{3-12}$, alkyl group;

$X^1$ and $X^2$ are independently a sulfur or oxygen atom; and

M is an alkali metal cation.

The compounds represented by formula IV include the alkyl thiocarbonates (both $X^1$ and $X^2$ are oxygen), alkyl dithiocarbonates ($X^1$ is S, $X^2$ is O) and the alkyl trithiocarbonates (both $X^1$ and $X^2$ are sulfur).

Examples of preferred alkyl monothiocarbonates include sodium ethyl monothiocarbonate, sodium isopropyl monothiocarbonate, sodium isobutyl monothiocarbonate, sodium amyl monothiocarbonate, potassium ethyl monothiocarbonate, potassium isopropyl monothiocarbonate, potassium isobutyl monothiocarbonate, and potassium amyl monothiocarbonate. Preferred alkyl dithiocarbonates include potassium ethyl dithiocarbonate, sodium ethyl dithiocarbonate, potassium amyl dithiocarbonate, sodium amyl dithiocarbonate, potassium isopropyl dithiocarbonate, sodium isopropyl dithiocarbonate, sodium sec-butyl dithiocarbonate, potassium sec-butyl dithiocarbonate, sodium isobutyl dithiocarbonate, potassium isobutyl dithiocarbonate, and the like. Examples of alkyl trithiocarbonates include sodium isobutyl trithiocarbonate and potassium isobutyl trithiocarbonate. It is often preferred to employ a mixture of an alkyl monothiocarbonate, alkyl dithiocarbonate and alkyl trithiocarbonate.

Preferred thionocarbamates correspond to the formula

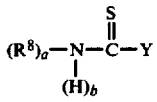

(V)

wherein each $R^8$ is independently in each occurrence a $C_{1-10}$, preferably a $C_{1-4}$, more preferably $C_{1-3}$, alkyl group;

Y is $-S^-M^+$ or $-OR^9$, wherein $R^9$ is a $C_{2-10}$, preferably a $C_{2-6}$, more preferably a $C_{3-4}$, alkyl group;

a is the integer 1 or 2; and b is the integer 0 or 1, wherein a+b must equal 2.

Preferred thionocarbamates include dialkyl dithiocarbamates (a=2, b=0 and Y is $S^-M^+$) and alkyl thionocarbamates (a=1, b=1 and Y is $-OR^6$). Examples of preferred dialkyl dithiocarbamates include methyl butyl dithiocarbamate, methyl isobutyl dithiocarbamate, methyl sec-butyl dithiocarbamate, methyl propyl dithiocarbamate, methyl isopropyl dithiocarbamate, ethyl butyl dithiocarbamate, ethyl isobutyl dithiocarbamate, ethyl sec-butyl dithiocarbamate, ethyl propyl dithiocarbamate, and ethyl isopropyl dithiocarbamate. Examples of preferred alkyl thionocarbamates include include N-methyl butyl thionocarbamate, N-methyl isobutyl thionocarbamate, N-methyl sec-butyl thionocarbamate, N-methyl propyl thionocarbamate, N-methyl isopropyl thionocarbamate, N-ethyl butyl thionocarbamate, N-ethyl isobutyl thionocarbamate, N-ethyl sec-butyl thionocarbamate, N-ethyl propyl thionocarbamate, and N-ethyl isopropyl thionocarbamate.

Preferred thiophosphates generally correspond to the formula

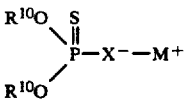

(VI)

wherein each $R^{10}$ is independently in each occurrence hydrogen, aryl or a $C_{1-10}$, preferably a $C_{2-8}$, alkyl group; more preferably an aryl having from 6 to 10 carbon atoms; most preferably cresyl;

X is oxygen or sulfur; and

M is an alkali metal cation.

Of compounds of the formula VI, those preferably employed include the monoalkyl dithiophosphates (one $R^7$ is hydrogen and the other $R^7$ is an alkyl or aryl and X is S), dialkyl dithiophosphates (both $R^7$ are alkyl or aryl and X is S) and dialkyl monothiophosphate (both $R^7$ are alkyl or aryl and X is O).

Examples of preferred monoalkyl dithiophosphates include ethyl dithiophosphate, propyl dithiophosphate, isopropyl dithiophosphate, butyl dithiophosphate, sec-butyl dithiophosphate, and isobutyl dithiophosphate. Examples of dialkyl or aryl dithiophosphates include sodium diethyl dithiophosphate, sodium di-sec-butyl dithiophosphate, sodium diisobutyl dithiophosphate, and sodium diisoamyl dithiophosphate. Preferred monothiophosphates include sodium diethyl monothiophosphate, sodium di-sec-butyl monothiophosphate, sodium diisobutyl monothiophosphate, and sodium diisoamyl monothiophosphate.

Preferably, the composition of this invention comprises (a) the monosulfide collector and (b) the alkyl thiocarbonate, thionocarbamate, thiophosphate, or mixture thereof, in a ratio such that the composition is an effective collector for metal-containing sulfide minerals and sulfidized metal-containing oxide minerals in a froth flotation process. The composition preferably comprises (a) between about 10 and about 90 percent by weight of monosulfide collector; and (b) between about 10 and about 90 percent by weight of an alkyl thiocarbonate, thionocarbamate, thiophosphate or mixtures thereof.

The composition of this invention more preferably comprises (a) between about 20 and about 80 percent by weight of a sulfide collector; and (b) between about 20 and about 80 percent by weight of an alkyl thiocarbonate, thionocarbamate, thiophosphate or mixtures thereof.

The composition of this invention even more preferably comprises (a) between about 30 and 70 percent by weight of a sulfide collector; and (b) between about 30 and 70 percent by weight of an alkyl thiocarbonate, thionocarbamate, thiophosphate or mixtures thereof. In its most preferred embodiment, the ratio of sulfide collector to alkyl thiocarbonate, thionocarbamate, thiophosphate or mixtures thereof is such that the recovery of metal-containing sulfide minerals or sulfidized metal-containing oxide minerals in a froth flotation process is higher than either component could recover at the same weight dosage. More preferably, the dosage at which the collector is used, is that dosage at which the component (b) of the composition when used alone gives a higher recovery than the sulfide collector gives at such level.

The novel collector composition of this invention gives higher recoveries, often with better grade than can be achieved with the use of either collector component alone. Grade is defined as the fractional amount of a desired metal contained in the material collected in the froth.

Hydrocarbon means herein an organic compound containing carbon and hydrogen atoms. The term hydrocarbon includes the following organic compounds: alkanes, alkenes, alkynes, cycloalkanes, cycloalkenes, cycloalkynes, aromatics, aliphatic and cycloaliphatic aralkanes and alkyl-substituted aromatics.

Aliphatic refers herein to straight- and branched-chain, and saturated and unsaturated, hydrocarbon compounds, that is, alkanes, alkenes or alkynes. Cycloaliphatic refers herein to saturated and unsaturated cyclic hydrocarbons, that is, cycloalkenes and cycloalkanes.

Cycloalkane refers to an alkane containing one, two, three or more cyclic rings. Cycloalkene refers to mono-, di- and polycyclic groups containing one or more double bonds.

Hydrocarbyl means herein an organic radical containing carbon and hydrogen atoms. The term hydrocarbyl includes the following organic radicals: alkyl, alkenyl, alkynyl, cycloalkyl, cycloalkenyl, aryl, aliphatic and cycloaliphatic aralkyl and alkaryl. The term aryl refers herein to biaryl, biphenylyl, phenyl, naphthyl, phenanthrenyl, anthracenyl and two aryl groups bridged by an alkylene group. Alkaryl refers herein to an alkyl-, alkenyl- or alkynyl-substituted aryl substituent wherein aryl is as defined hereinbefore. Aralkyl means herein an alkyl group, wherein aryl is as defined hereinbefore.

$C_{1-20}$ alkyl includes straight- and branched-chain methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl groups.

The novel collector compositions of this invention are useful for the recovery by froth flotation of metal-containing sulfide minerals and sulfidized metal-containing oxide minerals from ores. An ore refers herein to material as it is taken out of the ground and includes the desired metal-containing minerals in admixture with the gangue. Gangue refers herein to those materials which are of no value and need to be separated from the desired metal-containing minerals.

Ores for these compositions include sulfide mineral ores containing copper, zinc, molybdenum, cobalt, nickel, lead, arsenic, silver, chromium, gold, platinum, uranium and mixtures thereof. Examples of metal-containing sulfide minerals which may be concentrated by froth flotation using this invention include copper-bearing minerals such as covellite ($CuS$), chalcocite ($Cu_2S$), chalcopyrite ($CuFeS_2$), bornite ($Cu_5FeS_4$), valleriite ($Cu_2Fe_4S_7$ or $Cu_3Fe_4S_7$), tetrahedrite ($Cu_3SbS_2$), enargite ($Cu_3(As,Sb)S_4$), tennantite ($Cu_{12}As_4S_{13}$), cubanite ($Cu_2SFe_4S_5$), brochantite ($Cu_4(OH)_6SO_4$), antlerite ($Cu_3SO_4(OH)_4$), famatinite ($Cu_3(SbAs)S_4$), and bournonite ($PbCuSbS_3$); lead-bearing minerals such as galena ($PbS$); antimony-bearing minerals such as stibnite ($Sb_2S_3$); zinc-bearing minerals such as sphalerite ($ZnS$); silver-bearing minerals such as argentite ($Ag_2S$) and stephanite ($Ag_5SbS_4$); chromium-bearing minerals such as daubreelite ($FeSCrS_3$); nickel-bearing minerals such as pentlandite [$(FeNi)_9S_8$]; molybdenum-bearing minerals such as molybdenite ($MoS_2$); and platinum- and palladium-bearing minerals such as cooperite ($Pt(AsS)_2$). Preferred metal-containing sulfide minerals include molybdenite ($MoS_2$), chalcopyrite ($CuFeS_2$), galena ($PbS$), pentlandite [$(FeNi)_9S_8$], sphalerite ($ZnS$) and bornite ($Cu_5FeS_4$).

Sulfidized metal-containing oxide minerals are minerals which are treated with a sulfidization chemical to give the treated minerals sulfide characteristics, so the minerals can be recovered in froth flotation using collectors which recover sulfide minerals. Sulfidization results in oxide minerals having sulfide characteristics. Oxide minerals are sulfidized by contact with compounds which react with the minerals to form a sulfur bond or affinity. Such methods are well known in the art. Such compounds include sodium hydrosulfide, sulfuric acid and related sulfur-containing salts such as sodium sulfide.

Sulfidized oxide minerals for which the invention can be used include oxide minerals containing copper, aluminum, iron, titanium, magnesium, chromium, manganese, tin, uranium and mixtures thereof. Examples of metal-containing oxide minerals which may be concentrated by froth flotation using the present invention include copper-bearing minerals such as cuprite ($Cu_2O$), tenorite ($CuO$), malachite ($Cu_2OH)_2CO_3$), azurite ($Cu_3(OH)_2(CO_3)_2$), atacamite ($Cu_2Cl(OH)_3$), chrysocolla ($CuSiO_3$); aluminum-bearing minerals such as corundum; zinc-containing minerals such as zincite ($ZnO$), and smithsonite ($ZnCO_3$); tungsten-bearing minerals such as wolframite [$(Fe,Mn)WO_4$]; nickel-bearing minerals such as bunsenite (NiO); molybdenum-bearing minerals such as wulfenite ($PbMoO_4$) and powellite ($CaMoO_4$); iron-containing minerals such as hematite and magnetite; chromium-containing minerals such as chromite ($FeOCr_2O_3$); iron- and titanium-containing minerals such as ilmenite; magnesium- and aluminum-containing minerals such as spinel; titanium-containing minerals such as rutile; manganese-containing minerals such as pyrolusite; tin-containing minerals such as cassiterite; and uranium-containing minerals such as uraninite, pitchblende ($U_2O_5(U_3O_8)$) and gummite ($UO_3nH_2O$).

In a preferred embodiment, metal-containing sulfide minerals are recovered, particularly sulfide minerals having high natural hydrophobicity in an unoxidized state. The term "hydrophobicity in the unoxidized state" applies to a freshly ground mineral or a mineral having a fresh surface which demonstrates a tendency to float without collector addition. In a more preferred embodiment of this invention sulfide minerals containing copper, nickel, lead, zinc, or molybdenum are recovered. In an even more preferred embodiment, sulfide minerals containing copper are recovered.

The collectors of this invention can be used in any concentration which gives the desired recovery of the desired minerals. In particular, the concentration used is dependent upon the particular mineral or minerals to be recovered, the grade of the ore to be subjected to the froth flotation process and the desired quality of the mineral to be recovered. Preferably, the collectors of this invention are used in concentrations of 0.001 kg to 1.0 kg per metric tone of ore, more preferably between about 0.010 kg and 0.2 kg of collector per metric ton of ore to be subjected to froth flotation.

Frothers are preferably used in the froth flotation process of this invention. Any frother well-known in the art, which results in the recovery of the desired metal value is suitable.

Frothers useful in this invention include any frothers known in the art which give the recovery of the desired mineral value. Examples of such frothers include $C_{5-8}$ alcohols, pine oils, cresols, $C_{1-4}$ alkyl ethers of polypropylene glycols, dihydroxylates of polypropylene glycols, glycols, fatty acids, soaps, alkylaryl sulfonates, and the like. Furthermore, blends of such frothers may also be used. All frothers which are suitable for beneficiation of mineral ores by froth flotation can be used in this invention.

Further, in the process of this invention it is contemplated that the compositions of this invention can be used in mixtures with other collectors well-known in the art. Collectors, known in the art, which may be used in admixture with the compositions of this invention are those which will give the desired recovery of the desired mineral value. Examples of other collectors which can be used include dialkyl thioureas, dialkyl and diaryl thiophosphonyl chlorides, dialkyl and diaryl dithiophosphonates, alkyl mercaptans, xanthogen formates, xanthate esters, mercapto benzothiazoles, fatty acids and salts of fatty acids, alkyl sulfuric acids and salts thereof, alkyl and alkaryl sulfonic acids and salts thereof, alkyl phosphoric acids and salts thereof, alkyl and aryl phosphoric acids and salts thereof, sulfosuccinates, sulfosuccinamates, primary amines, secondary amines, tertiary amines, quaternary ammonium salts, alkyl pyridinium salts, guanidine, and alkyl propylene diamines.

SPECIFIC EMBODIMENTS

The following examples are included for illustration and do not limit the scope of the invention or claims. Unless otherwise indicated, all parts and percentages are by weight.

Example 1

Copper/Molybdenum Ore from Western Canada

Bags of homogeneous ore containing chalcopyrite and molybdenite minerals are prepared with each bag containing 1200 g. The rougher flotation procedure is to grind a 1200 g charge with 800 cc of tap water for 14 minutes in a ball mill having a mixed ball charge (to produce approximately a 13 percent plus 100 mesh grind). This pulp is transferred to an Agitair 1500-ml flotation cell outfitted with an automated paddle removal system. The slurry pH is adjusted to 10.2 using lime. No further pH adjustments are made during the test. The standard frother is methyl isobutyl carbinol (MIBC). A four-stage rougher flotation scheme is then followed.

| | | |
|---|---|---|
| STAGE 1: | Collector | 0.0042 kg/metric ton |
| | MIBC | 0.015 kg/metric ton |
| | | condition 1 minute |
| | | float collect concentrate for 1 minute |
| STAGE 2: | Collector | 0.0021 kg/metric ton |
| | MIBC | 0.005 kg/metric ton |
| | | condition 0.5 minute |
| | | float collect concentrate for 1.5 minutes |
| STAGE 3: | Collector | 0.0016 kg/metric ton |
| | MIBC | 0.005 kg/metric ton |
| | | condition 0.5 minute |
| | | float collect concentrate for 2.0 minutes |
| STAGE 4: | Collector | 0.0033 kg/metric ton |
| | MIBC | 0.005 kg/metric ton |
| | | condition 0.5 minute |
| | | float collect concentrate for 2.5 minutes |

The results are compiled in Table I.

TABLE I

| Collector | Cu R-7[1] | Moly R-7[1] | Cu Grade[2] | Mo Grade[2] |
|---|---|---|---|---|
| potassium amyl xanthate[3] | 0.776 | 0.725 | 0.056 | 0.00181 |
| 1,2-epithiooctane[3] | 0.710 | 0.691 | 0.093 | 0.00325 |
| 50/50 blend of potassium amyl xanthate and 1,2-epithiooctane | 0.794 | 0.766 | 0.054 | 0.00177 |
| methyl hexyl sulfide[3] | 0.699 | 0.697 | 0.107 | 0.00386 |
| 50/50 blend of potassium amyl xanthate and methyl hexyl sulfide | 0.790 | 0.793 | 0.056 | 0.00169 |

[1]R-7 is the fractional recovery after 7 minutes
[2]Grade is the fractional content of the specified metal contained in the total weight collected in the froth
[3]Not an example of the invention The recoveries of Cu and Mo at 7 minutes using the collector composition and method of this invention exceed the 7-minute recoveries using the individual collector component alone.

Example 2

A copper/nickel ore containing chalcopyrite, pentlandite and pyrrhotite is floated using 0.0028 kg/metric ton of DOWFROTH® 1263 frother and a collector dosage of 0.28 kg/metric ton. A series of samples are drawn from the feeders to plant rougher bank and placed in buckets to give approximately 1200 g of solid. The contents of each bucket are then used to perform a time-recovery profile on a Denver cell using an automated paddle and constant pulp level device with individual concentrates selected at 1.0, 3.0, 6.0 and 12.0 minutes. The chemicals are added with a condition time of one minute before froth removal is started. There is no stage addition of reagents. Individual concentrates are dried, weighed, ground and statistically representative samples prepared for assay. The results are compiled in Table II.

TABLE II

| Collector | Cu R-12[2] | Ni R-12[2] | Pyrrhotite R-12[2] |
|---|---|---|---|
| sodium amyl xanthate[1] | 0.930 | 0.839 | 0.358 |
| 1,2-epithiooctane[1] | 0.927 | 0.751 | 0.247 |
| dibutyl sulfide[1] | 0.928 | 0.630 | 0.190 |
| 50/50 blend of 1,2-epithiooctane and sodium amyl xanthate | 0.927 | 0.844 | 0.344 |
| 50/50 blend of dibutyl sulfide and sodium amyl xanthate | 0.931 | 0.824 | 0.245 |

[1]Not an example of the invention
[2]R-12 is the fractional recovery after 12 minutes The collector blends of this invention give Ni recoveries that significantly exceed those recoveries using the individual component alone.

Example 3

Froth Flotation of a complex Pb/Zn/Cu/Ag Ore from Central Canada

Uniform 1000-g samples of ore, containing galena, sphalerite, chalcopyrite and argentite, are prepared. For each flotation run, a sample is added to a rod mill along with 500 ml of tap water and 7.5 ml of $SO_2$ solution. Six and one-half minutes of mill time are used to prepare a feed of 90 percent less than 200 mesh (75 microns). After grinding, contents are transferred to a cell fitted with an automated paddle for froth removal, and the cell attached to a standard Denver flotation mechanism.

A two-stage flotation is then performed. Stage I consists of a copper/lead/silver rougher, and in Stage II consists of a zinc rougher. To start the Stage I flotation, 1.5 g/kg $Na_2CO_3$ is added (pH of 9 to 9.5), followed by the addition of collector(s). The pulp is then conditioned for 5 minutes with air and agitation. This is followed by a 2-minute condition period with agitation only. MIBC frother is then added (standard dose of 0.015 ml/kg). Concentrate is collected for 5 minutes of flotation and labeled as copper/lead rougher concentrate.

The Stage II flotation consists of adding 0.5 kg/metric ton of $CuSO_4$ to the cell remains of Stage I. The pH is then adjusted to 10.5 with lime addition. This is followed by a condition period of 5 minutes with agitation only. pH is then rechecked and adjusted back to 10.5 with lime. At this point, the collector(s) are added, followed by a 5-minute condition period with agitation only. MIBC frother is then added (standard dose of 0.020 ml/kg). Concentrate is collected for 5 minutes and labeled as zinc rougher concentrate.

Concentrate samples are dried, weighed, and appropriate samples prepared for assay using X-ray techniques. Using the assay data, fractional recoveries and grades are calculated using standard mass balance formulae. The results are compiled in Table III.

TABLE III

| Run | Stage (Rougher) | Collector | Dosage (kg/t) | pH | Ag R-5[1] | Ag Grade[2] | Cu R-5[1] | Cu Grade[2] | Pb R-5[1] | Pb Grade[2] | Zn R-5[1] | Zn Grade[2] |
|---|---|---|---|---|---|---|---|---|---|---|---|---|
| 1[3] | Cu/Pb | A | 0.005 | 9.5 | 0.886 | 0.275 | 0.941 | 0.107 | 0.794 | 0.050 | 0.220 | — |
| | | B | 0.0075 | | | | | | | | | |
| | Zn | A | 0.020 | 10.5 | 0.052 | — | 0.030 | — | 0.077 | — | 0.762 | 0.48 |
| | | C | 0.015 | | | | | | | | | |
| 2 | Cu/Pb | D | 0.0125 | 9.5 | 0.778 | 0.312 | 0.893 | 0.136 | 0.662 | 0.057 | 0.145 | — |
| | Zn | D | 0.020 | 10.5 | 0.103 | — | 0.048 | — | 0.145 | — | 0.812 | 0.497 |
| | | C | 0.015 | | | | | | | | | |
| 3 | Cu/Pb | D | 0.005 | 9.5 | 0.891 | 0.272 | 0.942 | 0.110 | 0.795 | 0.052 | 0.218 | |
| | | B | 0.0075 | | | | | | | | | |
| | Zn | D | 0.035 | 10.5 | 0.030 | — | 0.018 | — | 0.045 | — | 0.570 | 0.532 |

[1]R-5 is the actual fractional recovery after 5 minutes
[2]Grade is the fractional content of the specified metal contained in the total weight collected in the froth
[3]Not an example of the invention
A - sodium ethyl xanthate
B - dithiophosphate (sodium-di-sec-butyl dithiophosphate)
C - thionocarbamate (N—ethyl isopropyl thionocarbamate)
D - dihexyl sulfide
R-5 is the actual recovery after 5 minutes In Table III, there are two test conditions which logically allow comparison of the recoveries associated with the collector compositions of this invention to those recoveries achievable with an individual component used alone.

Comparing the Cu/Pb flotation (Stage I) of Run 2 with collector D used alone versus the Cu/Pb flotation (Stage I) of Run 3 using the collector blend D+B, the results illustrate the greater Ag, Cu, Pb recoveries achieved with the collector blends of this invention.

The Zn flotation (Stage II) of Run 3 compared to the Zn flotation (Stage II) of Run 2 also illustrates the obvious increase in the Zn recovery associated with the blend versus that of the component used alone.

Other runs using single compoments in various stages are not reported in Table III as many of the single components when used alone simply do not perform adequately enough to collect meaningful data for comparison. For example, collector B used alone in Stage I for Cu and Pb gives less than 0.500 recovery.

Example 4

Froth Flotation of a Complex Cu/Mo Ore from South America

A 500-g quantity of an ore, containing several copper-containing sulfide minerals and molybdenite, is placed in a rod mill having one-inch (2.5 cm) rods along with 257 g of deionized water and a quantity of lime. The resulting mixture is ground to produce a size distribution of suitable fineness. The ground slurry is transferred to an Agitar 1500-ml flotation cell outfitted with an automated paddle removal system. The slurry is agitated at 1150 rpm and the pH adjusted to the appropriate value (shown in Table IV) with either more lime or hydrochloric acid.

At this point, the collector(s) is added to the float cell (45 g/metric ton), followed by a conditioning time of one minute, at which time the frother, DOWFROTH® 250 is added (34.4 g/metric ton). After an additional conditioning time of one minute, the air to the float cell is turned on at a rate of 4.5 liters/minute and the automatic froth removal paddle started. Samples of the froth are collected at 0.5, 1.5, 3.0, 5.0 and 8.0 minutes.

The samples are dried overnight in an oven along with the flotation tailings. The dried samples are weighed, pulverized to a suitable degree of fineness for dissolution, and dissolved in acid for analysis on a DC Plasma Spectrograph. The results are compiled in Table IV.

TABLE IV

| Run | Collectors | Dosage (g/metric ton) | pH | Cu R-8[1] | Mo R-8[1] |
|---|---|---|---|---|---|
| 1 | isopropyl ethyl thionocarbamate[2] | 22.7 | 10.5 | 0.891 | 0.742 |
| | sodium isopropyl xanthate[2] | 22.7 | | | |
| 2 | ethyl octyl sulfide[2] | 45.4 | 10.5 | 0.854 | 0.791 |
| 3 | isopropyl ethyl thionocarbamate | 11.4 | 10.5 | 0.893 | 0.808 |
| | sodium isopropyl xanthate | 11.4 | | | |
| | ethyl octyl sulfide | 22.7 | | | |
| 4 | isopropyl ethyl thionocarbamate[2] | 22.7 | 8.0 | 0.912 | 0.780 |
| | sodium isopropyl xanthate[2] | 22.7 | | | |
| 5 | ethyl octyl sulfide[2] | 45.4 | 8.0 | 0.887 | 0.822 |
| 6 | isopropyl ethyl thionocarbamate | 11.4 | 8.0 | 0.901 | 0.831 |
| | sodium isopropyl xanthate | 11.4 | | | |
| | ethyl octyl sulfide | 22.7 | | | |

[1]R-8 is the actual fractional recovery after 8 minutes
[2]Not an example of this invention The recoveries of Cu at 8 minutes all approach the theoretical limit of 1.0.

Clearly, the collector blends of this invention provide Mo recoveries that significantly exceed those using the individual components alone. For example, the Mo recovery of Run 3 clearly exceeds the weighted average of Runs 1 and 2.

What is claimed is:

1. A composition comprising (a) an organic compound containing at least 4 carbon atoms and one or more monosulfide units, (b) an alkyl thiocarbonate, a thionocarbamate, a thiophosphate or mixture thereof.

2. The composition of claim 1 wherein the sulfur atoms of the monosulfide unit(s) are bonded to nonaromatic carbon atoms.

3. The composition of claim 2 wherein the ratio of organic sulfide to the alkyl thiocarbamate, thionocarbamate, thiophosphate or mixtures thereof is such that the composition is an effective collector for metal-containing sulfide minerals and sulfidized metal-containing oxide minerals in a froth flotation process.

4. The composition of claim 3 wherein the organic sulfide corresponds to the formula $$R^1—S—R^2;$$

the thiocarbonates correspond to the formula $$R^7—X^2—\overset{\overset{X^1}{\|}}{C}—S^-M^+;$$

the thionocarbamates correspond to the formula $$(R^8)_a—\underset{\underset{(H)_b}{|}}{N}—\overset{\overset{S}{\|}}{C}—Y;$$

and the thiophosphates correspond to the formula $$\begin{matrix} R^{10}O \\ \\ R^{10}O \end{matrix}\!\!>\overset{\overset{S}{\|}}{P}—X^-—M^+$$

wherein $R^1$ and $R^2$ are independently hydrocarbyl or substituted hydrocarbyl;

$R^1$ and $R^2$ may combine to form a heterocyclic ring structure with S; with the proviso that S is bound to an aliphatic or cycloaliphatic carbon atom;

$R^7$ is a $C_{1-20}$ alkyl group;

$R^8$ is independently in each occurrence a $C_{1-10}$ alkyl group;

$R^{10}$ is independently in each occurrence hydrogen, an aryl group or a $C_{1-10}$ alkyl group;

M is an alkali metal cation;

X, $X^1$ and $X^2$ are independently in each occurrence S or O;

Y is $—S^-M^+$ or $OR^9$ where $R^9$ is a $C_{2-10}$ alkyl group;

a is the integer 1 or 2;

b is the integer 0 or 1; and $a+b=2$.

5. The composition of claim 4 wherein the organic sulfide is of the formula

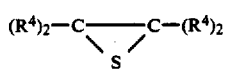

wherein $R^4$ is independently hydrogen, a hydrocarbyl or substituted hydrocarbyl; provided at least one $R^4$ is not hydrogen.

6. The composition of claim 4 which comprises (a) between about 10 and about 90 percent by weight of the organic sulfide; and (b) between about 10 to about 90 percent by weight of an alkyl thiocarbonate, thionocarbamate, thiophosphate or mixtures thereof.

7. The composition of claim 6 which comprises (a) between about 20 and about 89 percent by weight of the organic sulfide; and (b) between about 20 and about 80 percent by weight of an alkyl thiocarbonate, thionocarbamate, thiophosphate or mixtures thereof.

8. The composition of claim 7 wherein $R^1$ and $R^2$ are independently aliphatic, cycloaliphatic or aralkyl, unsubstituted or substituted with one or more hydroxy, cyano, halo, —$OR^3$ or —$SR^3$ moieties, wherein $R^3$ is a hydrocarbyl radical and $R^1$ and $R^2$ may combine to form a heterocyclic ring with S;

$R^7$ is $C_{2-16}$ alkyl;

$R^8$ is $C_{1-14}$ alkyl;

$R^9$ is $C_{2-6}$ alkyl;

$R^{10}$ is aryl or $C_{2-8}$ alkyl; and

M is a sodium or potassium cation.

9. The composition of claim 8 wherein the total number of carbon atoms in the organic sulfide is from about 4 to about 20.

10. The composition of claim 9 wherein $R^1$ and $R^2$ are cycloaliphatic or aliphatic, which are unsubstituted or substituted with one or more hydroxy, cyano, halo, —$OR^3$ or —$SR^3$ moieties; $R^7$ is $C_{3-12}$ alkyl; $R^8$ is $C_{1-3}$ alkyl; $R^9$ is $C_{2-6}$ alkyl; and $R^{10}$ is $C_{2-8}$ alkyl or cresyl.

11. The composition of claim 10 wherein the organic sulfide has from about 6 to about 16 carbon atoms.

12. The composition of claim 11 wherein $R^1$ and $R^2$ are independently alkyl, cycloalkyl or alkenyl.

13. The composition of claim 11 wherein $R^1$ is methyl or ethyl and $R^2$ is a $C_{5-11}$ alkyl or $C_{5-11}$ alkenyl group.

14. The composition of claim 7 wherein the organic sulfide corresponds to the formula

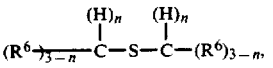

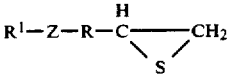

or

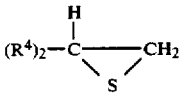

wherein $R^6$ is independently aliphatic or substituted aliphatic group;

n is an integer of 0, 1, 2 or 3;

$R^1$ is an aliphatic or cycloaliphatic or substituted aliphatic or cycloaliphatic or aralkyl group;

Z is oxygen or sulfur;

R is a $C_{1-10}$ aliphatic or cycloaliphatic group; and $R^4$ is a $C_{1-12}$ alkyl or alkenyl group.

15. The composition of claim 14 which comprises (a) the organic sulfide; and (b) an alkyl thiocarbonate which comprises an alkyl monothiocarbonate, alkyl dithiocarbonate or alkyl trithiocarbonate.

16. The composition of claim 4 wherein $R^1$ and $R^2$ are not the same.

17. A method of recovering metal-containing sulfide minerals or sulfidized metal-containing oxide minerals from an ore which comprises subjecting the ore, in the form of an aqueous pulp, to a froth flotation process in the presence of a flotating amount of a flotation collector wherein the collector comprises the composition of Claim 2 under conditions such that the metal-containing sulfide or sulfidized metal-containing mineral is recovered in the froth.

18. The method of claim 17 wherein the organic sulfide corresponds to the formula $$R^1—S—R^2;$$

the thiocarbonates correspond to the formula

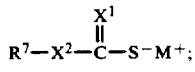

the thionocarbamates correspond to the formula

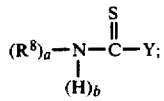

and the thiophosphates correspond to the formula

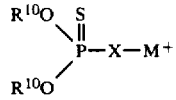

wherein $R^1$ and $R^2$ are independently hydrocarbyl, or substituted hydrocarbyl substituted; $R^1$ and $R^2$ may combine to form a hetereocyclic ring structure with S and $R^1$ and $R^2$ together contain at least 4 carbon atoms;

$R^7$ is a $C_{1-20}$ alkyl group;

$R^8$ is independently in each occurrence a $C_{1-10}$ alkyl group;

$R^{10}$ is independently in each occurrence hydrogen, an aryl group, or a $C_{1-10}$ alkyl group;

M is an alkali metal cation;

X, $X^1$ and $X_2$ are independently in each occurrence S or O;

Y is —$S^-M^+$ or —$OR^9$, $R^9$ is a $C_{2-10}$ alkyl group;

a is the integer 1 or 2;

b is the integer 0 or 1; and a+b=2.

19. The method of claim 18 which comprises (a) between about 10 to about 90 percent by weight of the organic sulfide; and (b) between about 10 and about 90 percent by weight of an alkyl thiocarbonate, thionocarbamate, thiophosphate or mixtures thereof.

20. The method of claim 19 which comprises (a) between about 20 and about 80 percent by weight of the organic sulfide; and (b) between about 20 and about 80 percent by weight of an alkyl thiocarbonate, thionocarbamate, thiophosphate or mixtures thereof.

21. The method of claim 18 wherein $R^1$ and $R^2$ are independently aliphatic, cycloaliphatic or aralkyl, unsubstituted or substituted with one or more hydroxy, cyano, halo, —$OR^3$ or —$SR^3$ moieties, wherein $R^3$ is a hydrocarbyl radical and $R^1$ and $R^2$ may combine to form a heterocyclic ring with S, with the proviso that S is bonded to an aliphatic or cycloaliphatic carbon atom; $R^7$ is $C_{2-16}$ alkyl; $R^8$ is $C_{1-4}$ alkyl; $R^9$ is $C_{2-6}$ alkyl; $R^{10}$ is $C_{2-8}$ alkyl or cresyl; and M is a sodium or potassium cation.

22. The method of claim 21 wherein the total number of carbon atoms in the organic sulfide is from about 4 to about 20.

23. The method of claim 21 wherein $R^1$ and $R^2$ are cycloaliphatic or aliphatic, which are unsubstituted or substituted with one or more hydroxy, cyano, halo, —$OR^3$ or —$SR^3$ moieties; and $R^7$ is $C_{3-12}$ alkyl; $R^8$ is $C_{1-3}$ alkyl; $R^9$ is $C_{2-6}$ alkyl; and $R^{10}$ is $C_{2-8}$ alkyl or cresyl.

24. The method of claim 23 wherein the organic sulfide has from about 6 to about 16 carbon atoms.

25. The method of claim 24 wherein $R^1$ and $R^2$ are independently alkyl, cycloalkyl or alkenyl.

26. The method of claim 25 wherein $R^1$ is methyl or ethyl and $R^2$ is a $C_{5-11}$ alkyl or $C_{5-11}$ alkenyl group.

27. The method of claim 20 wherein the organic sulfide corresonds to the formula

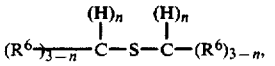

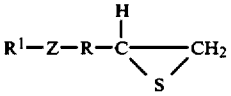

or

-continued

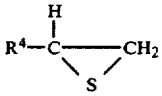

wherein $R^6$ is independently aliphatic or substituted aliphatic;

n is an integer of 0, 1, 2 or 3;

$R^1$ is an aliphatic, cycloaliphatic or substituted aliphatic or cycloaliphatic group moiety;

Z is oxygen or sulfur;

R is a $C_{1-10}$ aliphatic or cycloaliphatic group; and $R^4$ is a $C_{1-12}$ alkyl or alkenyl group.

28. The method of claim 27 which comprises (a) the organic sulfide; and (b) an alkyl thiocarbonate which comprises an alkyl monothiocarbonate, alkyl dithiocarbonate or alkyl trithiocarbonate.

29. The method of claim 28 wherein a metal-containing sulfide mineral is recovered in the froth.

30. The method of claim 29 wherein the metal-containing sulfide mineral recovered in the froth contains copper, zinc, molybdenum, cobalt, nickel, lead, arsenic, silver, chromium, gold, platinum, uranium or mixtures thereof.

31. The method of claim 30 wherein the metal-containing sulfide mineral recovered in the froth is a molybdenite, chalcopyrite, sphalerite, galena, bornite or pentlandite.

32. The method of claim 31 wherein the sulfide collector is present in a concentration of from about 0.001 kg of collector/ton to about 1.0 kg of collector/ton of feed to flotation.

* * * * *

UNITED STATES PATENT AND TRADEMARK OFFICE

CERTIFICATE OF CORRECTION

PATENT NO. : 4,702,822

DATED : Oct. 27, 1987

INVENTOR(S) : Klimpel et al.

It is certified that error appears in the above-identified patent and that said Letters Patent is hereby corrected as shown below:

ON THE TITLE PAGE,

Under U.S. PATENT DOCUMENTS please insert --3,425,218 1969 Attebo--.

Under FOREIGN PATENT DOCUMENTS please insert --491461 U.S.S.R.--.

Column 2, line 67, please delete "$R^1$-S-$R_2$" and insert --$R^1$-S-$R^2$--.

Column 4, line 5, please delete "$C_{1-18}$" and insert --$C_{1-8}$--.

Column 6, line 31, please delete "include" second occurrence.

Column 9, line 32, please delete "tone" and insert --ton--.

Column 12, line 44 (TABLE III) please insert -- - -- under column Zn, Grade$^2$.

Column 13, line 1, please delete "compoments" and insert --components--.

Column 15, line 1, please delete "to" and insert --and--. (Claim 6)

Column 15, line 5, please delete "89" and insert --80--. (Claim 7)

Column 15, line 18, please delete "$C_1$-14" and insert --$C_1$-4--.(Claim 8)

Column 16, line 30, please delete "$R^{10}O$ S P-X-M$^+$ " and insert --$R^{10}O$ S P-X--M$^+$ $R^{10}O$ $R^{10}O$ P-X-M$^+$ --. (Claim 18)

Column 16, line 37, please delete "substituted". (Claim 18)

Column 16, line 38, please delete "hetereocyclic" and insert --heterocyclic--. (Claim 18)

Column 16, line 48, please delete "$X_2$" and insert --$X^2$--. (Claim 18)

Column 16, line 55, please delete "to" and insert --and--.(Claim 19)

Column 17, line 25, delete "corresonds" and insert --corresponds--.

Signed and Sealed this

Twenty-first Day of June, 1988

*Attest:*

DONALD J. QUIGG

*Attesting Officer*

*Commissioner of Patents and Trademarks*